United States Patent [19]

Jeanson et al.

[11] 4,143,614

[45] Mar. 13, 1979

[54] DEVICE FOR MOUNTING A SCREW-RUDDER ON A FLOATING VEHICLE

[75] Inventors: René H. Jeanson, Auzay; Daniel Vagner, Fontenay le Conte, both of France

[73] Assignee: Societe Anonyme Francaise du Ferodo, Paris, France

[21] Appl. No.: 865,602

[22] Filed: Dec. 29, 1077

[30] Foreign Application Priority Data

Jan. 7, 1977 [FR] France ..... 77 00307
Sep. 2, 1977 [FR] France ..... 77 26652

[51] Int. Cl.[2] ..... B65H 5/12
[52] U.S. Cl. ..... 115/41 HT
[58] Field of Search ..... 115/41 R, 41 HT, 18 R, 115/34, 35; 248/4

[56] References Cited

U.S. PATENT DOCUMENTS

| | | | |
|---|---|---|---|
| 2,668,679 | 2/1954 | Harneit | 248/4 |
| 2,928,631 | 3/1960 | Hartman | 115/41 R |
| 3,683,841 | 8/1972 | Krautkremer | 115/41 R |

FOREIGN PATENT DOCUMENTS

| | | | |
|---|---|---|---|
| 1521436 | 4/1968 | France | 115/41 R |

*Primary Examiner*—Trygve M. Blix
*Assistant Examiner*—Jesus D. Sotelo
*Attorney, Agent, or Firm*—Young & Thompson

[57] ABSTRACT

A screw-rudder assembly is mounted at the bottom of a steering shaft which rotates in a tubular casing which is mounted on slide shoes which slide in vertical slide guides fixed to a support which is mounted on a floating vehicle. A power cylinder connects the tubular casing to the support and slides the casing upwardly to regulate the depth of immersion of the screw and pivots the casing upwardly about upper slide shoes when bottom slide shoes are released through passages in the slide guides, to lift the screw-rudder out of the water.

12 Claims, 13 Drawing Figures

DEVICE FOR MOUNTING A SCREW-RUDDER ON A FLOATING VEHICLE

BACKGROUND OF THE INVENTION

1. Field of the Invention

The present invention relates to a device for mounting a screw-rudder on a floating vehicle.

2. Description of the Prior Art

Devices are known for mounting a screw-rudder, comprising a support, substantially vertical slide guide means fastened to the support, and a tubular casing mounted for sliding along the slide guide means for adjusting the depth of immersion of the screw. The tubular casing is adapted to be raised in order to lift the screw out of the water, by power cylinder means connected between the support and the tubular casing to control as required the sliding and lifting of the tubular casing. A steering shaft is mounted for rotation in the tubular casing, and a screw-carrier assembly is rigidly suspended on the said steering shaft.

In known devices of this kind the power cylinder means generally comprises two independent power cylinders, one of which slides the tubular casing for the adjustment of the depth of immersion of the screw, while the other raises the tubular casing in order to lift the screw out of the water for inspection and repair.

In order to simplify the construction it has also been proposed to perform these two functions by means of a single power cylinder, but this cylinder must then have a long stroke, which makes it expensive, increases its dimensions, and introduces potential sources of operating faults.

SUMMARY OF THE INVENTION

A main object of the invention is to provide a device for mounting a screw-rudder which does not have these disadvantages, and whose construction is simple, robust, inexpensive, and of small dimensions with excellent operation.

A device according to the invention for mounting a screw-rudder on a floating vehicle comprises a support for mounting on a floating vehicle, substantially vertical slide guides fastened to the support and top and bottom slide shoes slidable in the slide guides. A tubular casing housing a rotatable steering shaft, on which a screw-carrier assembly is rigidly suspended, is connected to the slide shoes. The connection of the tubular casing to the top slide shoes is pivotal and the slide guides have passages through which the bottom slide shoes are released when the tubular casing is raised by pivoting relative to the top slide shoes by power cylinder means connected to the tubular casing and to the support.

With this arrangement the tubular casing is slid by connecting the power cylinder body to the support in a lower position of that body, so that the piston rod causes the slide shoes to slide in the slide guides thereby sliding the tubular casing relative to the support.

For raising the screw the casing is slid to an upper position and the top slide shoes are held. When the power cylinder is operated the cylinder body rises, after which the cylinder body is fixed in an upper position and the piston rod is then extended to cause the top slide shoes to be applied against an abutment when the bottom slide shoes are opposite the release passages. The casing then pivots upwardly when bottom slide shoes are released from the slide guides.

The simplicity of this construction and also its strength and small dimensions will be evident.

In a modification, guide means are associated with the power cylinder body in order to control the movements of that body between the bottom position and top position, and vice versa.

With this arrangement the operator will only have to unpin and repin the power cylinder body using pinning means which locks the power cylinder body, without having to intervene in the movement of the power cylinder.

In a preferred embodiment the guide means comprises a lever which is mounted for pivoting on the support and on which the body of the power cylinder is articulated.

The present invention also relates to a floating vehicle provided with such a device.

BRIEF DESCRIPTION OF THE DRAWINGS

Some embodiments of the invention are described below, by way of example, with reference to the accompanying drawings, in which.

DESCRIPTION OF THE PREFERRED EMBODIMENTS

Figure 1:
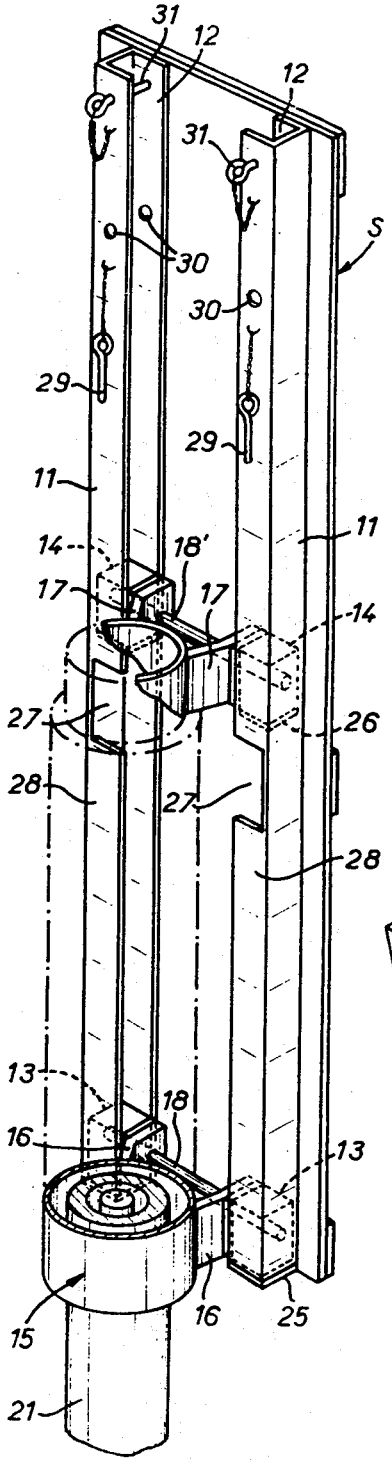
FIG. 1 is a view in perspective of a screw-rudder mounting device according to the invention, with parts broken away.

In the embodiment shown in FIGS. 1 to 9 a device for mounting a screw-rudder is for mounting on floating vehicles of all kinds, such as boats, ships, barges, dinghies, pontoons, submersible craft and amphibious vehicles.

The floating vehicle has at the rear, FIGS. 5 to 9, a chassis C of any suitable shape for mounting the screw-rudder or steerable propeller, which has the general reference 10.

On the chassis C is fixed a support S carrying two vertical slide guides 11 each of U-shaped section, and defining a channel 12. The two slide guides 11 extend parallel facing one another, with the channels 12 face-to-face. In each slide guide 11 are mounted two slide shoes 13 and 14 spaced apart from one another.

A tubular casing 15 is slidably mounted on the slide guides 11 by means of the shoes 13 and 14. To effect this the tubular casing 15 has rigidly attached to it two arms 16 which, in the embodiment illustrated, are fixed on the bottom shoes 13, and two arms 17 which are pivotally mounted on the upper shoes 14.

Figure 2:
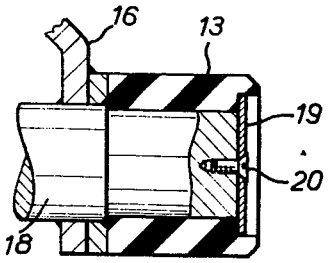
FIGS. 2 and 3 are views in section and on a larger scale of a bottom slide shoe and an upper slide shoe respectively in the device of FIG. 1.

The mounting of the arms 16 on the shoes 13 is shown in greater detail in FIG. 2. The arms 16 are fastened to a spacer pin 18, on the ends of which the two shoes 13 are mounted. Each shoe 13 is made of an elastomer or of any other suitable material, in order to damp vibrations. The shoe 13 is shaped as a parallelepiped, and its outside shape ensures good sliding conditions in the slide guides 11. Each shoe 13 is held axially on the pin 18 by an end retainer plate 19 which is screwed at 20 to the pin 18. The bottom shoes 13 are mounted on the arms 16 in such a way that they cannot turn relative to the pin 18. To this end it is sufficient that the screw 20 be locked on the pin 18 and for the end plate 19 to have a square section, for example.

Figure 3:
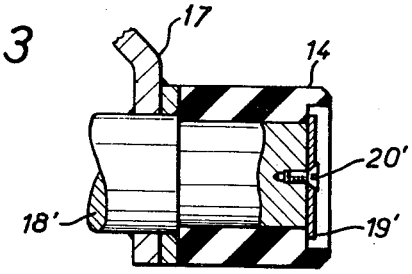

The mounting of the upper shoes 14 on the arms 17 is similar and is illustrated in FIG. 3. The mounting comprises a pin 18', end plates 19', and screws 20'. In this case, however, the end plates 19' are circular and each has a clearance relative to its shoe 14 which permits the shoe 14 to turn relative to the pin 18. The construction of the shoes 14 is similar to that of the shoes 13.

In the tubular casing 15 there is steerably mounted a descending steering shaft 21 the bottom end 22 of which carries a bulb-shaped screw-rudder assembly 23 rigidly suspended from the shaft. The screw 24 is mounted for rotation in the bulb-shaped assembly 23.

Drive means are provided for rotationally driving the screw 24 for propelling the floating vehicle, and a steering drive is also provided for turning the steerable shaft 21 in such a manner as to vary the course steered by the floating vehicle.

Each bottom shoe 13 is mounted in its slide guide 11 for sliding between a bottom limit position defined by an abutment plate 25 and an upper limit position facing a passage 27 provided in the rear side wall 28 of the slide guide 11. The passages 27 enable the shoes 13 to be released from the slide guides 11 when the shoes have reached their upper position.

Each upper shoe 14 is mounted in its slide guide 11 for movement between a bottom position, which is defined by an abutment plate 26, and two top positions. The lower top position of the shoes 14 is defined by movable pins 29 adapted to be inserted into holes 30 which face one another in the slide guides 11. This lower top position is occupied by the shoes 14 when they rest on the pins 29 above that position. When the shoes 14 occupy this lower top position, the shoes 13 are in the slide guides 11 below the passages 27, and cannot yet be released from the slide guides 11.

The other top position of the shoes 14, which is an upper top positon, is defined by pins 31 or other abutment means, which need not be detachable, and against which the shoes 14 bear from below. When the shoes 14 abut under the pins 31 the shoes 13 reach a position opposite the passages 27 and can be released from the slide guides 11.

A hydraulic power cylinder 40 is connected to the tubular casing 15 and controls sliding of the casing on the slide guides 11 and also as required raising of the casing 15 as will now be described.

Figure 4:
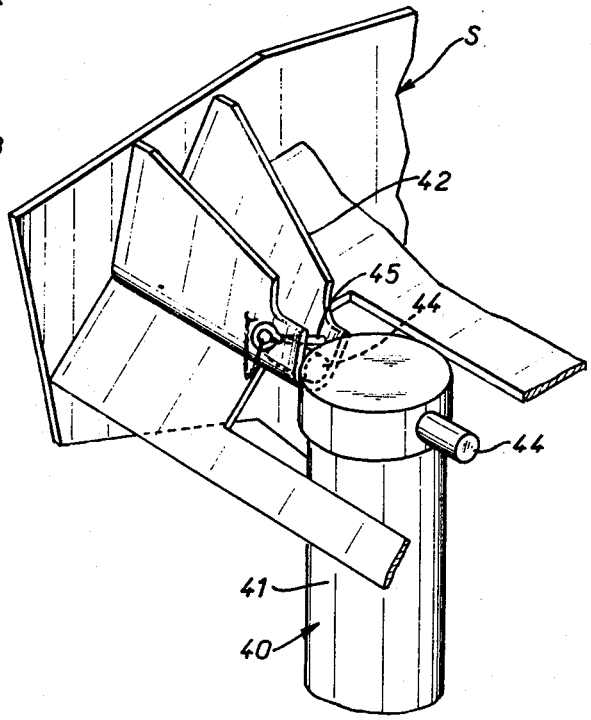
FIG. 4 is a view in perspective of a support means for a power cylinder body which is adjustable in position, parts being broken away.

The hydraulic power cylinder 40, FIG. 4, comprises a cylinder body 41 adapted to be carried by cradles 42 of the support S, in a position selected as required from two possible positions. For this purpose the power cylinder body 41 has bottom studs 43, FIGS. 5 to 9, and upper studs 44 which are spaced apart on the body 41. Either the studs 43 or the studs 44 can be engaged in the cradles 42 and held by a pin 45 so that the cylinder body 41 is pivotally supported by the support S. The power cylinder rod 46 is articulated at 47 on the tubular casing 15.

Figures 5, 6, 7, 8, 9:
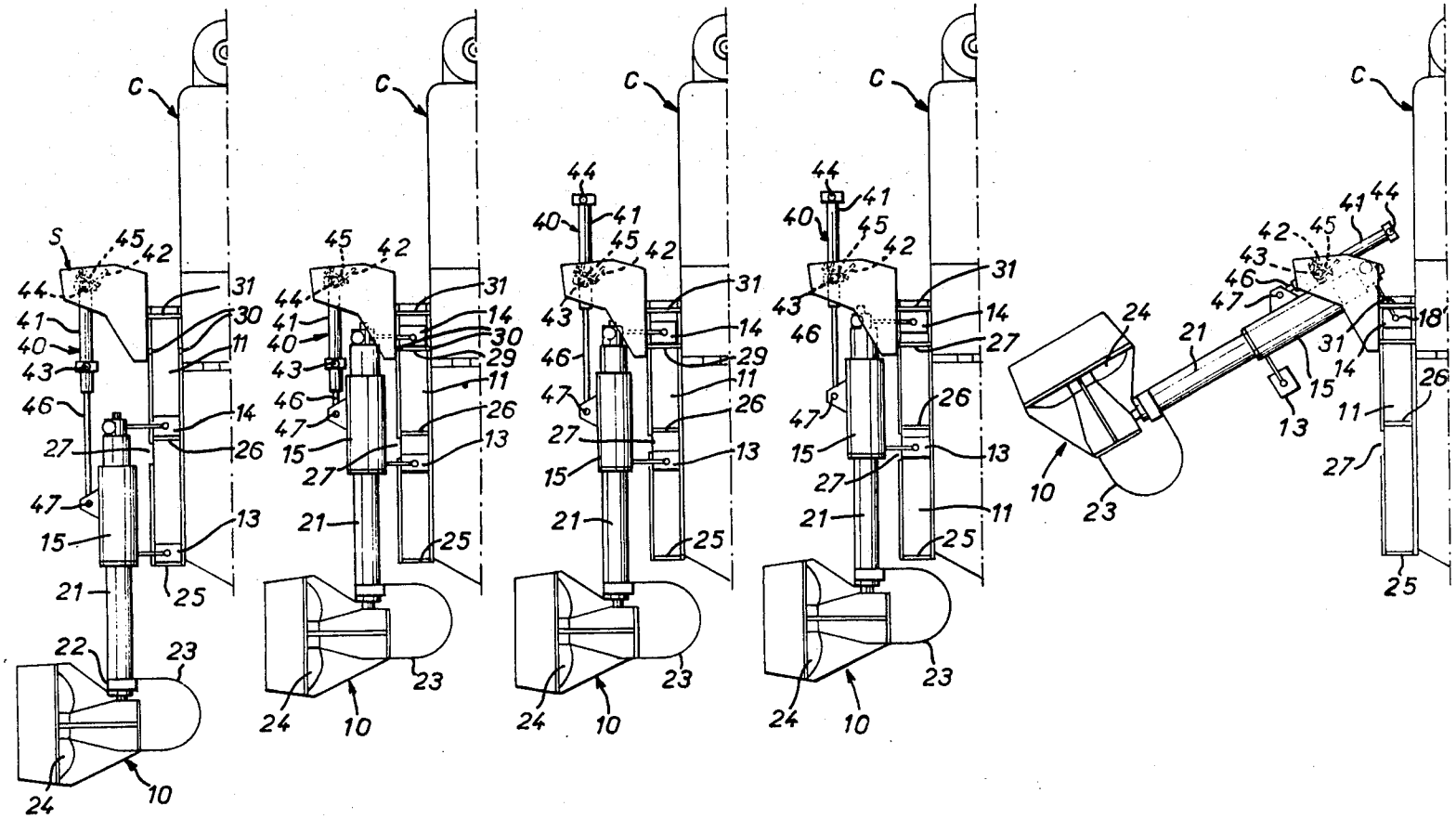
FIGS. 5, 6, 7, 8, and 9 are diagrammatic side elevation views of the device of FIG. 1 in various positions.

For normal operation the upper studs 44 are engaged in the cradles 42 held by pins 45 so as to secure the power cylinder 40 in a bottom position, FIG. 5.

By hydraulic control of the power cylinder 40 the rod 46 is raised or lowered, thereby displacing the tubular casing 15 vertically by the sliding of the shoes 13 and 14 in the slide guides 11, and the depth of penetration of the screw 24 in the water can thus be adjusted. It should be noted that this adjustment can be made during operation.

For the inspection or rapair of the bulb-shaped assembly 23 and of the screw 24 it is helpful to bring them out of the water. For this purpose, while the studs 44 are still engaged at 42 and held by pins 45, the power cylinder 40 is operated so as to bring the tubular casing 15 from the position shown in FIG. 5 to that shown in FIG. 6, in which the shoes 14 are situated above the holes 30, while the shoes 13 have not yet reached the release passages 27. The pins 29 are placed in position in the holes 30 and the shoes 14 rest on these pins 30, so that the tubular casing 15 is suspended by the bearing of the shoes 14 on the pins 29. The studs 44 are released from the cradles 42 and the power cylinder 40 is operated. The rod 46 does not move, but the cylinder body 41 is raised. The studs 43 are then engaged in the cradles 42 and held by pins 45, FIG. 7, and then the power cylinder 40 is operated again. This raises the tubular casing 15 until the shoes 14, FIG. 8, bear against the upper pin 31 and the shoes 13 reach the release passages 27.

The power cylinder 40 is further operated, thus developing a pivoting couple. The cylinder body 41 pivots about the studs 43 in the cradles 42, and the tubular casing 15 pivots about the pins 18' of the shoes 14. The shoes 13 move through the passages 27 and are released from the slide guides 11. The tubular casing 15 is thus raised from the position shown in FIG. 8 to that shown in FIG. 9, bringing the screw 24 out of the water.

Once the inspection or repair has been completed the opposite operation is sufficient to lower the shoes 13 back into the slide guides and to lower the shoes 14 below the pin holes 30.

The particularly simple, economical, and robust construction and also the small dimensions of this device will be appreciated.

Referring to FIGS. 10 to 13, whereas in the embodiment described with reference to FIGS. 1 to 9 the movements of the body 41 of the power cylinder 40 between its two positions is controlled manually, in the embodiment of FIGS. 10 to 13, guide means 50 are associated with the body 41 of the power cylinder 40 in order to control its movements between the two positions.

These guide means comprise a lever 50 which is pivotally mounted at 51 on the support S, and on which the body 41 of the power cylinder 40 is pivoted at 52. The lever 50 comprises two arms 53 and 54 disposed one on each side of the body 41 of the power cylinder 40, and a cross-member 55 which connects the two arms 53 and 54.

Pinning means can be employed to lock the lever 50 to the body 41 of the power cylinder 40 in each of two positions, bottom and top, of the body 41.

Figure 10:
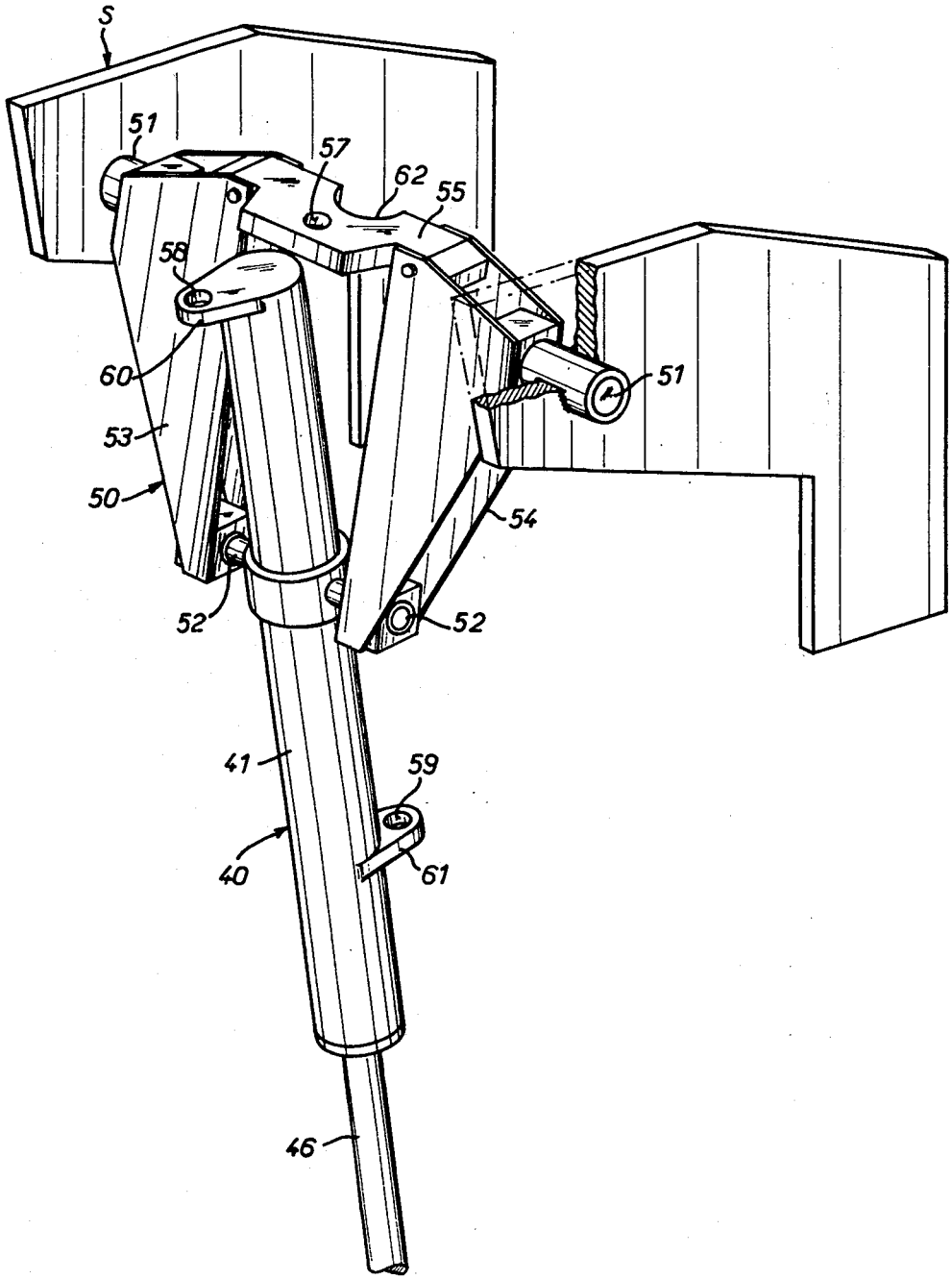
FIG. 10 is a view in perspective of a modified screw-rudder mounting device according to the invention and shows in perspective means for guiding a power cylinder body between a bottom position and a top position or vice versa.
Figure 13:
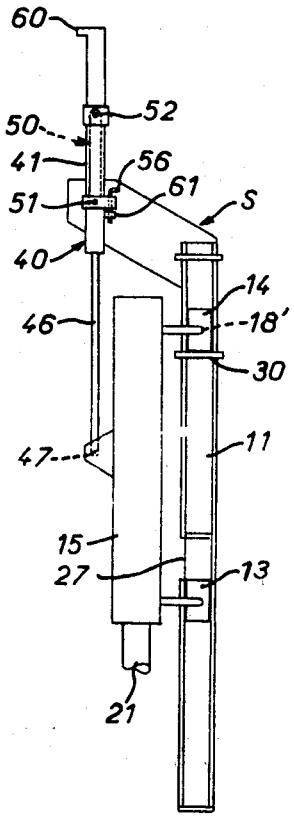
FIGS. 12 and 13 are similar views to FIG. 11 but showing the power cylinder body in an intermediate position and in an upper position respectively.
Figure 12:
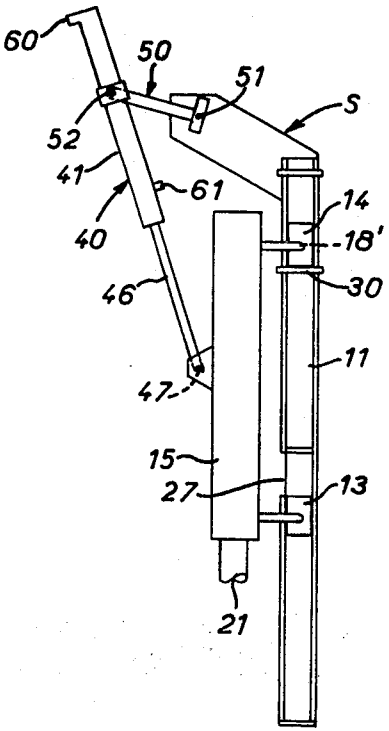
Figure 11:
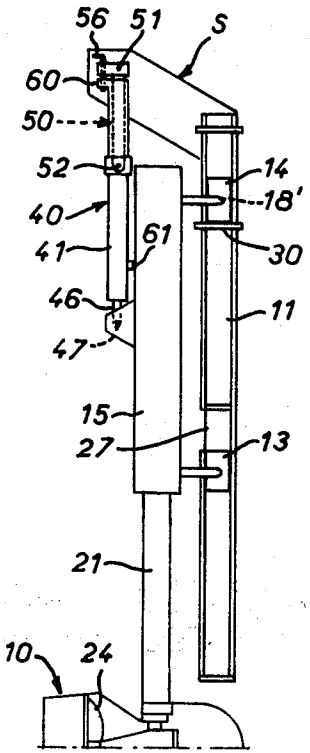
FIG. 11 shows diagrammatically the power cylinder body of FIG. 10 in the lower position.

These pinning means comprise a pin 56, FIGS. 11 and 13, which is shaped to be introduced into a hole 57 in the cross-member 55, FIG. 10, and either into a hole 58 in the body 41 in the bottom position, or into a hole 59 in the body 41 in the top position.

The holes 58 and 59 are formed in two opposite lugs 60 and 61 on the body 41.

The body 41 of the power cylinder is supported freely below the cross-member 55, with the lug 60 near the cross-member 55. A recess 62 is provided in the cross-member 55 to enable the body 41 to be engaged therein in the top position, with the lug 61 adjacent the cross-member 55.

For normal operation the pin 56 is engaged in the holes 57 and 58 so as to hold the power cylinder 40 in the bottom position.

By means of a hydraulic drive for the cylinder 40 its rod 46 is raised or lowered, thus moving the casing 15 vertically by the sliding of the shoes 13 and 14 in the slide guides 11. The depth to which the screw 24 penetrates into the water can thus be adjusted.

For the inspection or repair of the screw-rudder 10 it is useful to bring it out of the water.

To this end, while the pin 56 is still engaged in the holes 57 and 58 the power cylinder 40 is operated to raise the shoes 14 sufficiently in the slide guides, until the shoes 14 can rest on pins 30 engaged in the slide guides, FIG. 11. The pin 56 is then removed from the holes 57 and 58 and the power cylinder 40 is operated. Since the rod 46 cannot move downwards, the body 41 of the power cylinder 40 is raised. This displacement is accurately guided by the lever 50, which pivots at 51 on the support S, FIG. 12. When the body 41 of the power cylinder 40 has reached the top position, FIG. 13, and engages in the recess 62, the pin 56 is inserted into the holes 57 and 59.

Continued operation of the power cylinder 40, whose body is now held, causes the rod 46 to raise the casing 15 and then to pivot it about the shoes 14 which are in their top position, while the shoes 13 are released through the passages 27, from the slide guides 11, in the manner described for the preceding embodiment.

It will be appreciated that through the action of the lever 50 the movements of the power cylinder 40 between the bottom position shown in FIG. 11 and the top position shown in FIG. 13 are guided under excellent conditions.

In the example illustrated in FIGS. 10 to 13 the body 41 and the lever 50 are accurately aligned in the bottom position and also in the top position, but at the commencement of movement there could be a jamming action preventing the movement. It is therefore expedient to initiate the movement by a slight lateral push, for example by hand, which is not difficult. It would also be possible to envisage providing slight misalignment between the parts in the two positions.

With the construction which has just been described, a shock applied to the screw-rudder assembly 10 does not entail the rick of causing accidental disengagement of the pin 56, because the shock will be absorbed by the pivots 51 and 52.

We claim:

1. A device for mounting a screw-rudder on a floating vehicle, comprising:

a support for mounting on a floating vehicle;

substantially vertical slide guide means fastened to the support;

a tubular casing for housing a steering shaft which casing is slidably mounted on said slide guide means for adjusting the depth of the screw;

a steering shaft which is mounted for rotation in the tubular casing;

a screw-carrier assembly rigidly suspended from the steering shaft;

top and bottom slide shoe means slidable in said slide guide means, said tubular casing being mounted on said bottom slide shoe means and being pivotally mounted on said top slide shoe means, and said slide guide means being formed with passages through which said bottom slide shoe means can be released when the tubular casing is raised to lift the screw-carrier assembly from the water; and power cylinder means connected to the tubular casing and adjustably connected to the support to control as required the sliding of the tubular casing relative to the support and the raising of the tubular casing when said lower slide shoe means is released from the slide guide means through said passages.

2. A device according to claim 1, wherein means connecting the power cylinder means to the support are adjustable selectively to dispose the power cylinder means in a bottom position for the sliding of the tubular casing relative to the support and a top position for the raising of the said tubular casing.

3. A device according to claim 2, including a removable abutment with which the slide shoe means engages when there is a change of position of the power cylinder means.

4. A device according to claim 2, wherein said power cylinder means includes a power cylinder body, and guide means are associated with the power cylinder body to control movement of the said body between the bottom position and the top position and vice versa.

5. A device according to claim 4, wherein said guide means comprises a lever which is pivotally mounted on the support and to which the power cylinder body is pivotally connected.

6. A device according to claim 5, including pinning means are adapted to lock the lever to the power cylinder body in the bottom and top positions of the power cylinder.

7. A device according to claim 6, wherein the lever comprises two arms disposed one on each side of the power cylinder body and a cross-member which connects the two arms and which is adapted to permit the power cylinder body to be locked to the cross-member by said pinning means.

8. A device according to claim 7, wherein the cross-member extends above the power cylinder body when the power cylinder is in its bottom position, and the cross-member is shaped with a recess in which the power cylinder body engages in the top position of the power cylinder.

9. A device according to claim 1, including an abutment under which the upper slide shoe means engages in order to position the bottom slide shoe means opposite said passages for release from the slide guide means.

10. A device according to claim 1, wherein the slide guide means comprise a pair of slide guides fastened to the support opposite one another and receiving a pair of bottom slide shoes and a pair of top slide shoes, the shoes of each pair of shoes being mounted on a pin which connects them to the tubular casing, and the power cylinder means comprises a single power cylinder.

11. A device according to claim 10, wherein the shoes of the pair of bottom slide shoes are fixed on their pin, and the shoes of the pair of top slide shoes are mounted for pivoting on their pin.

12. The device according to claim 10, wherein each shoe is made of elastomer material.

* * * * *